US005133330A

United States Patent [19]

Sharp

[11] Patent Number: 5,133,330

[45] Date of Patent: Jul. 28, 1992

[54] RELIEF PITCHER

[76] Inventor: John C. Sharp, 747 Butter Cemetery Rd., Forest Hills, La. 71430

[21] Appl. No.: 725,533

[22] Filed: Jul. 3, 1991

[51] Int. Cl.[5] ..... F41B 11/00

[52] U.S. Cl. ..... 124/56; 124/71; 124/50; 273/26 D

[58] Field of Search ..... 124/56, 71, 73, 81, 124/50, 49; 273/26 D

[56] References Cited

U.S. PATENT DOCUMENTS

| | | | |
|---|---|---|---|
| 2,700,379 | 1/1955 | Brigati | 124/50 X |
| 3,838,676 | 10/1974 | Kahelin | 124/81 X |
| 3,855,988 | 12/1974 | Sweeton | 124/50 X |
| 3,905,349 | 9/1975 | Nielsen et al. | 124/56 X |
| 3,915,143 | 10/1975 | Waller | 124/50 X |
| 3,989,027 | 11/1976 | Kahelin | 124/50 X |
| 3,999,754 | 12/1976 | Krzysztofiak et al. | 124/56 X |
| 4,021,037 | 5/1977 | Torbet | 124/56 X |
| 4,886,269 | 12/1989 | Marocco | 124/71 X |

*Primary Examiner*—Peter M. Cuomo
*Attorney, Agent, or Firm*—John M. Harrison

[57] ABSTRACT

An economical relief pitcher in which there is employed a plurality of tubes, at least one of them being employed as a firing tube and at least one being employed for storing balls to be fired, the firing tube being connected with a high volume source of air. A remote push actuator can be employed to actuate a rocker arm and actuator device for allowing a single ball at a time into the firing tube which is connected with a high volume source of air for firing. A delay is employed for effecting a delay from the pushing of the push actuator until the ball is fired. A lower tapered orifice is preferably employed for creating a suction pressure to help the balls get into the firing tube.

4 Claims, 1 Drawing Sheet

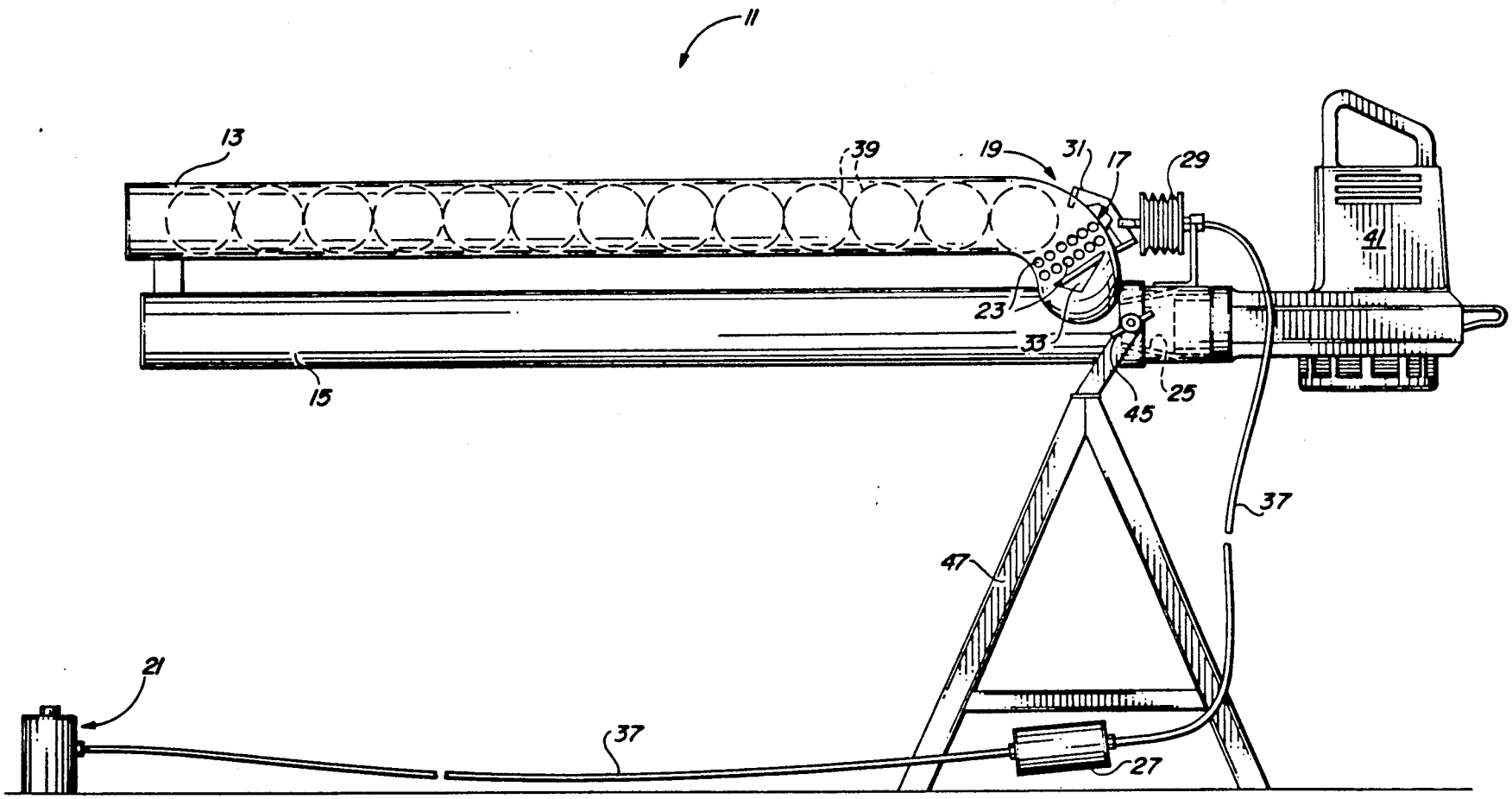
11
13
15
17
19
21
23
25
27
29
31
33
37
39
41
45
47

RELIEF PITCHER

FIELD OF THE INVENTION

This invention relates to ball pitching machines. More particularly, this invention relates to an economical ball pitching machine that can be employed without a computer or the like for control of same.

DESCRIPTION OF THE PRIOR ART

The prior art has seen the development of a wide variety of types of apparatuses for simulating the flight of a ball. These have ranged from earliest practice machines for practice by batters attempting to hit a thrown baseball or the like to tennis firing devices. Specifically, these have ranged from simple devices for sale at about $100.00 and used to practice batting in Little League parks, to elaborate computer controlled pitching machines such patented and described in U.S. Pat. No. 4,442,823. The physics of ball flight are known but to obtain accurate control is relatively expensive. It is difficult for an ordinary family to own a device to simulate pitching in an economical device such as the present invention.

SUMMARY OF THE INVENTION

Accordingly, it is an object of this invention to provide an economical relief pitching machine to simulate a thrown ball, the pitching machine being economical to be owned by a single family.

It is a particular object of this invention to create a pitching machine that is economical enough to be owned by a single family and can be employed to simulate the path, or trajectory, of a pitched ball, as by a pitcher throwing a ball.

These and other objects will become apparent from the descriptive matter hereinafter, particularly when taken in conjunction with the appended drawings.

In accordance with one embodiment of this invention, there is provided a relief pitcher comprising a plurality of tubes at least one being clear for firing balls responsive to flow of air behind a ball and at least a portion of the tube which may be also called a firing tube, the remainder of the plurality of tubes being available for storage of balls; air entry means for controlling flow of air into the firing tube, including a ball control means for allowing at least one ball into the firing tube from storage responsive to an actuator means; and an actuator means being remote from the plurality of tubes and connected with the ball control means for actuation to effect entry of only a single ball into the firing tube.

A delay means may be employed between the actuating means which can be pushed to actuate and before the actual firing of the ball is effected.

BRIEF DESCRIPTION OF DRAWINGS

The FIG. is a side elevational view, partly schematic, showing one embodiment of this invention.

DESCRIPTION OF PREFERRED EMBODIMENT(S)

Referring to the FIG., the Relief Pitcher 11 includes a pair plurality of tubes 13, 15; an air entry means 17 which includes a ball control means 19 for allowing a single ball to enter the firing tube responsive to energizing of the actuator means 21, as by a batter.

As indicated hereinbefore, a plurality of relief pitchers 11 are known, although as far as is known, none is as economical and simple in the design and concept as this invention.

The tubes 13, 15 are substantially straight throughout most of their length for firing, or storage of balls, respectively. At the point of entry of at least one ball into the firing tube 15, the top storage tube, or loading tube 13 may be bent to facilitate entry of a single ball from a plurality of balls that are stored therewithin. As implied hereinbefore, the air entry means 17 allows a single ball to be entered by way of ball control means 19.

The air entry means includes a pneumatic actuator bellows 29 which operates a rocker arm 31 for effecting entry of a single ball from the loading tube 13 and entry of air into the firing tube 15 after suitable delay which will be discussed in more detail hereinafter.

As illustrated herein, the air entry means includes as part of the actuator means 21, a bulb that can be depressed. The bulb may be located by some distance from the actual relief pitcher, for example, by 20 to 40 feet of hoses, to give the batter time to depress the actuator and then get the bat ready to hit a ball that will be pitched. This causes the pneumatic bellows to extend about $\frac{5}{8}$ inch and causes the rocker arm to release one ball. Air flows continuously through the firing tube 15.

Specifically, when the bellows move, the rocker arm rocks to block the next ball and allows one ball to fall into the firing tube after 2 or 3 seconds, after the delay by the delay means.

As can be seen in the FIG., a delay means 27 is provided intermediate the actuator means 21 and the air entry means 17. This allows a few second delay for the batter to get ready after he depresses the actuator means 21, a bulb or a switch as indicated.

The delay means may be provided by simply employing a small capillary. The small capillary may be one or more small passageways. Presently, about two passageways of about 0.032 inch are employed.

The delay means 27 will be described in more detail hereinafter but it is sufficient to note that a suitable delay is provided to give the batter time to energize the actuator means 21 and then get ready to hit a pitched ball such as a ball that may be blown by entry of pneumatic air behind the ball in the firing tube 15. While only a portion of the firing tube may be employed if desired, as illustrated, the pneumatic air is operable over the entire firing tube to cause the ball 39 as a single entering ball, once it has entered the firing tube and air is allowed to act on it to pick it or fire it.

The delay means 27 may provide only a few seconds delay and may constitute an economical device. As illustrated, the delay means 27 is simply a check valve which will delay the firing 2 to 3 seconds. The delay means 27 allows a short delay to get the batter ready after depressing the actuator means so that he can hit the pitched ball.

As illustrated, the machine is pivotal about a bolt illustrated by a wing nut 45 when the pitcher 11 in about 30 degrees elevation, it can pitch from 46 to 50 feet. Even higher angles can be employed for pop flies or the like.

A plurality of holes, or apertures, 23 are employed to relieve the vacuum so that only one ball at a time enters instead of the entire loading tube 13 feeling a vacuum therewithin. The cutout 33 also helps reduce the vacuum and the cutout is provided on each of the sides. The vacuum is created by a tapered orifice means 25 serving as a part of the air entry means and the ball control means, along with the holes or apertures 23.

As illustrated, the holes or apertures, 23 are spaced substantially uniformly around the loading tube 13 for attenuating the effect of the vacuum drawn from entry of air over the tapered orifice means 25.

As indicated, the tapered orifice means 25 is simply a venturi type approach in which the decreased air increases the velocity and hence lowers the pressure of the entering air. The entire tube 13 feels, somewhat, the vacuum formed by the entering air although the vacuum is attenuated by the hose, or apertures, 23.

The yard blower 41 is a high volume yard blower that can be commercially purchased and put on the relief pitcher 11 as desired. Other high volume sources that will supply the volume of air within a given small time interval can be employed. It is imperative that the air enter at a high volumetric rate in order that the ball be fired, rather than simply blown out of the firing tube 15.

As noted, the high volumetric rate source of air is connected with the firing tube 15 at all times.

The relief pressure, of course, is greater than the firing pressure of the air behind the ball 39 when it is to be fired.

A base 47 carries the pivotally mounted tubes 13, 15 and accoutrements. Any satisfactory base can be employed. As illustrated, the base 47 is simply a light weight tripod.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims.

What is claimed is:

1. A relief pitcher comprising:

(a) a pair of tubes, one of said tubes being clear of balls for firing balls responsive to continuous flow of air therethrough and behind a ball the other of said tubes being available for storing balls;

(b) air entry means provided in said other of said tubes and connected in air supply relationship to said one of said tubes for controlling the flow of air into said one of said tubes;

(c) a high volume air source mounted on one end of said one of said tubes for delivering said continuous flow of air therethrough;

(d) a rocker arm pivotally mounted on said other of said tubes and pneumatic bellows means connected to said rocker arm for selective actuation of said rocker arm by said pneumatic bellows means to effect sequential entry of only a single ball in said one of said tubes, whereby entry of air from said high volume air source under pressure through at least a portion of said one of said tubes propels the ball therefrom at a relatively high velocity responsive to actuation of said pneumatic bellows means.

2. The relief pitcher of claim 1 wherein said air entry means includes a tapered orifice portion for allowing a lowered pressure to be created and, hence, a suction created, responsive to said flow of air and to said firing tube behind said ball.

3. The relief pitcher of claim 1 wherein a delay means is connected intermediate a push actuator and said pneumatic bellow means.

4. The relief pitcher of claim 1 wherein said tubes are pivotally carried by a base.

* * * * *